US011214057B2

(12) United States Patent
Matsuzuki et al.

(10) Patent No.: US 11,214,057 B2
(45) Date of Patent: Jan. 4, 2022

(54) EJECTION APPARATUS, EJECTION CONTROL DEVICE, AND NON-TRANSITORY COMPUTER READABLE MEDIUM STORING PROGRAM CAUSING COMPUTER TO EXECUTE PROCESS FOR CONTROLLING EJECTION

(71) Applicant: FUJIFILM Business Innovation Corp., Tokyo (JP)

(72) Inventors: Masato Matsuzuki, Ebina (JP); Yoshiyuki Taguchi, Ebina (JP); Chikara Manabe, Ebina (JP); Kunio Miyakoshi, Ebina (JP); Maki Hasegawa, Ebina (JP)

(73) Assignee: FUIFIIM Business Imovation Corp., Tokyo (JP)

( * ) Notice: Subject to any disclaimer, the term of this patent is extended or adjusted under 35 U.S.C. 154(b) by 0 days.

(21) Appl. No.: 16/824,758

(22) Filed: Mar. 20, 2020

(65) Prior Publication Data

US 2021/0154996 A1 May 27, 2021

(30) Foreign Application Priority Data

Nov. 27, 2019 (JP) ..... JP2019-214721

(51) Int. Cl.
*B41J 2/045* (2006.01)
*B41J 11/46* (2006.01)
*B41J 15/00* (2006.01)

(52) U.S. Cl.
CPC ..... *B41J 2/04573* (2013.01); *B41J 2/04558* (2013.01); *B41J 2/04581* (2013.01); *B41J 11/46* (2013.01); *B41J 15/00* (2013.01)

(58) Field of Classification Search
CPC ..... B41J 2/0457
See application file for complete search history.

(56) References Cited

U.S. PATENT DOCUMENTS 6,068,362 A * 5/2000 Dunand ..... B41J 3/4078 347/16
2002/0081132 A1* 6/2002 Miyamoto ..... B41J 3/60 399/384

(Continued)

FOREIGN PATENT DOCUMENTS

| | | |
|---|---|---|
| JP | 2003-211770 | 7/2003 |
| JP | 4950859 | 3/2012 |
| JP | 5488450 | 3/2014 |

OTHER PUBLICATIONS

English language machine translation of JP 2003-211770.

*Primary Examiner* — Shelby L Fidler
(74) *Attorney, Agent, or Firm* — Fildes & Outland, P.C

(57) ABSTRACT

An ejection apparatus includes: a first ejection unit configured to eject droplets on a recording medium conveyed in a conveyance direction to form an image for detection; a first detection unit disposed downstream of the first ejection unit and configured to detect the image for detection; a second ejection unit disposed downstream of the detection unit and configured to eject droplets on the recording medium; and a control unit configured to: predict a first elongation amount of the recording medium based on a first difference between a first set time period and a first detection time period from a reference time point to a first detection time point when the image for detection is detected by the first detection unit; and perform delay control on the second ejection unit for delaying an ejection timing of the second ejection unit based on the predicted elongation amount.

10 Claims, 8 Drawing Sheets

(56) References Cited

U.S. PATENT DOCUMENTS

| | | | | |
|---|---|---|---|---|
| 2009/0002424 | A1 | 1/2009 | Kiyama et al. | |
| 2009/0115807 | A1* | 5/2009 | Tanaka | B41J 29/393 347/12 |
| 2009/0265950 | A1* | 10/2009 | Mizes | B41J 11/46 33/701 |
| 2010/0105153 | A1* | 4/2010 | Kiuchi | B41J 3/407 438/5 |
| 2010/0238224 | A1 | 9/2010 | Kiyama et al. | |
| 2012/0163843 | A1 | 6/2012 | Murayama | |
| 2017/0291435 | A1* | 10/2017 | Millan-Lorman | B41J 2/04573 |

* cited by examiner

EJECTION APPARATUS, EJECTION CONTROL DEVICE, AND NON-TRANSITORY COMPUTER READABLE MEDIUM STORING PROGRAM CAUSING COMPUTER TO EXECUTE PROCESS FOR CONTROLLING EJECTION

CROSS-REFERENCE TO RELATED APPLICATIONS

This application is based on and claims priority under 35 USC 119 from Japanese Patent Application No. 2019-214721 filed on Nov. 27, 2019.

BACKGROUND

Technical Field

The present invention relates to an ejection apparatus, an ejection control device, and a non-transitory computer readable medium storing a program causing a computer to execute a process for controlling ejection.

Related Art

Patent Literature 1 discloses a recording paper conveyance roller that conveys recording paper, and a color image recording apparatus that performs print recording in a line unit of different colors in the same area on the recording paper when the recording paper conveyance roller conveys the recording paper. The apparatus includes: a reading unit that takes a color order of recording units as k, c, m, y, records a registration mark at a constant time interval at the same time of print recording of the color k on the recording paper, and reads the registration mark; a calculation unit for calculating variation in a moving speed of the recording paper based on the read information of the resist mark; a data producing unit for producing correction data for an image recording timing in a line unit by the recording means of colors of c, m, and y based on the calculated variation in the moving speed of the recording paper; and a control unit for controlling the image recording timing by the recording unit of colors of c, m, and y based on the correction data produced by the data producing unit.

CITATION LIST

Patent Literature

Patent Literature 1: JP-A-2003-211770

SUMMARY

For example, when a first ejection unit ejects droplets on a recording medium to be conveyed, the recording medium swells and elongates in a conveyance direction. When the recording medium elongates in the conveyance direction, displacement sometimes occurs between an ejection position of the first ejection unit on the recording medium and an ejection position of a second ejection unit on the recording medium.

Aspects of non-limiting embodiments of the present disclosure relate to prevent the displacement between the ejection position of the first ejection unit on the recording medium and the ejection position of the second ejection unit on the recording medium as compared with a configuration in which an ejection timing of the second ejection unit is constant, regardless of an elongation amount of the recording medium in the conveyance direction.

Aspects of certain non-limiting embodiments of the present disclosure address the above disadvantages and/or other disadvantages not described above. However, aspects of the non-limiting embodiments are not required to address the disadvantages described above, and aspects of the non-limiting embodiments of the present disclosure may not address any of the disadvantages described above.

According to an aspect of the present disclosure, there is provided an ejection apparatus including a first ejection unit configured to eject droplets on a recording medium conveyed in a conveyance direction to form an image for detection on the recording medium; a first detection unit disposed downstream of the first ejection unit in the conveyance direction and configured to detect the image for detection; a second ejection unit disposed downstream of the first detection unit in the conveyance direction and configured to eject droplets on the recording medium; and a control unit configured to: predict a first elongation amount of the recording medium in the conveyance direction based on a first difference between a first set time period and a first detection time period from a reference time point to a first detection time point when the first detection unit detects the image for detection; and perform delay control on the second ejection unit for delaying an ejection timing of the second ejection unit based on the predicted elongation amount.

BRIEF DESCRIPTION OF DRAWINGS

Exemplary embodiment(s) of the present invention will be described in detail based on the following figures, wherein.

DETAILED DESCRIPTION

Hereinafter, an exemplary embodiment according to the exemplary invention will be described based on the drawings.

(Ink Jet Recording Apparatus 10)

Figure 1:
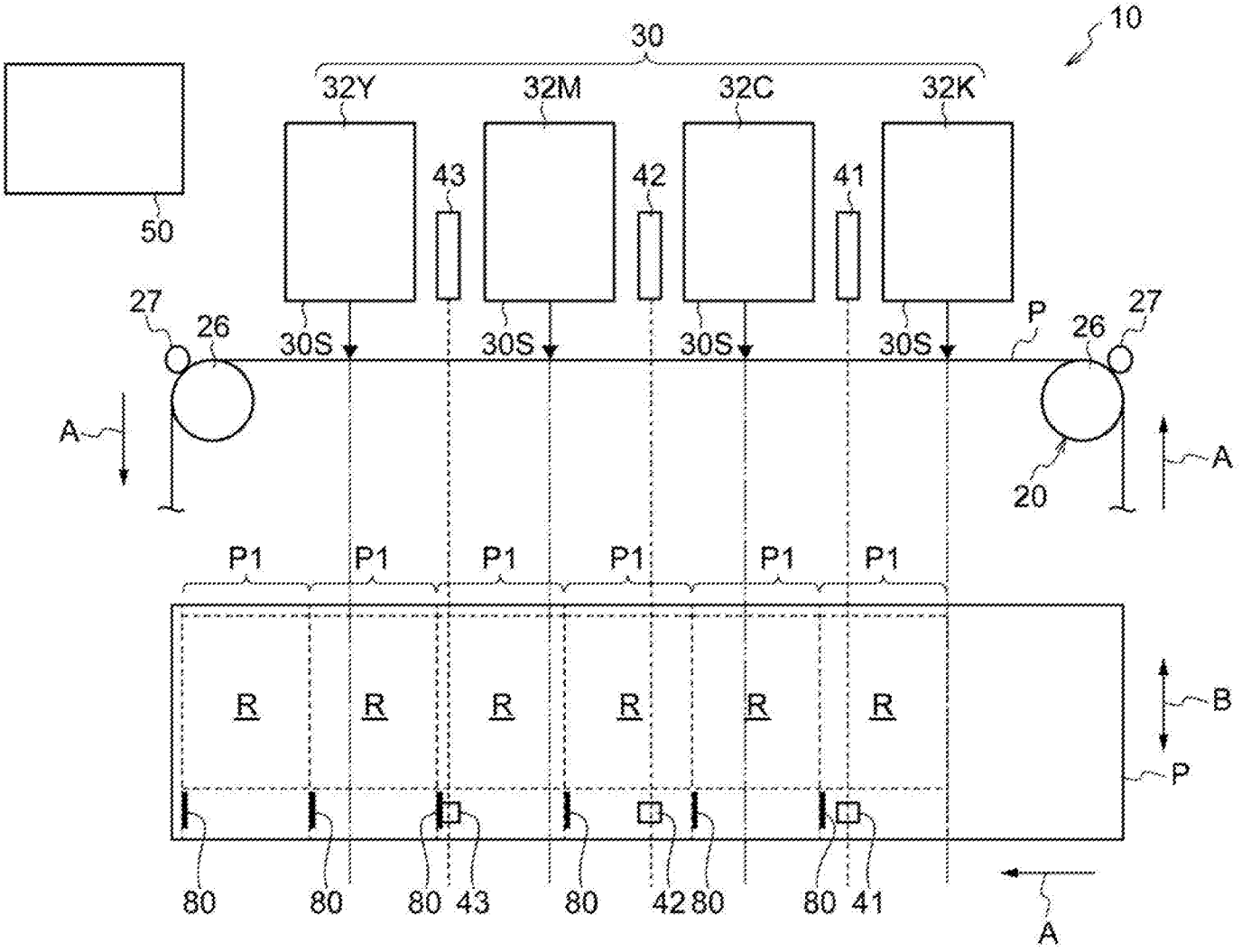
FIG. 1 is a schematic diagram showing a configuration of an ink jet recording apparatus according to an exemplary embodiment of the present invention.

First, an ink jet recording apparatus 10 is described. FIG. 1 is a schematic view showing a configuration of the inkjet recording apparatus 10. In FIG. 1, a side view of the ink jet recording apparatus 10 is shown in an upper part of a paper surface, and a plan view in which continuous paper P and detection units 41, 42, and 43 to be described later are viewed from the upper side is shown in a lower part of the paper surface.

The ink jet recording apparatus 10 shown in FIG. 1 is an example of an ejection apparatus that ejects droplets. Specifically, the ink jet recording apparatus 10 is a device that ejects ink droplets on a recording medium. More specifically, as shown in FIG. 1, the ink jet recording apparatus 10 is an apparatus that ejects ink droplets on the continuous paper P (an example of the recording medium) to form an image on the continuous paper P. In other words, the ink jet recording apparatus 10 may also be referred to as an example of an image forming apparatus that forms an image on a recording medium.

As shown in FIG. 1, the continuous paper P is a long recording medium having a length in a conveyance direction to be conveyed. Specifically, the continuous paper P is a paper in which a plurality of pages P1 are disposed along the conveyance direction.

As shown in FIG. 1, the ink jet recording apparatus 10 includes a conveyance mechanism 20, an ejection mechanism 30, detection units 41, 42, and 43, and a control device 50. Hereinafter, a specific configuration of each unit (the conveyance mechanism 20, the ejection mechanism 30, the detection units 41, 42, and 43, and the control device 50) of the ink jet recording apparatus 10 will be described.

(Conveyance Mechanism 20)

The conveyance mechanism 20 shown in FIG. 1 is a mechanism that conveys the continuous paper P. Specifically, for example, as shown in FIG. 1, the conveyance mechanism 20 includes a plurality of coiling rollers 26, a plurality of facing rollers 27, an unwinding roller (not shown), and a winding roller (not shown).

In the conveyance mechanism 20, while the winding roller (not shown) that is driven to rotate winds the continuous paper P, the unwinding roller (not shown) unwinds the continuous paper P, so that the continuous paper P is conveyed in a predetermined conveyance speed (hereinafter, sometimes referred to as a paper conveyance speed). The plurality of coiling rollers 26 are rollers on which the continuous paper P is coiled. The plurality of coiling rollers 26 are coiled around the continuous paper P between the unwinding roller (not shown) and the winding roller (not shown). Accordingly, a conveyance path of the continuous paper P from the unwinding roller (not shown) to the winding roller (not shown) is determined.

Each of the plurality of facing rollers 27 is disposed to face each of the plurality of coiling rollers 26. Specifically, the continuous paper P is sandwiched between each of the plurality of facing rollers 27 and each of the plurality of coiling rollers 26. The plurality of coiling rollers 26 and the plurality of facing rollers 27 rotate following the continuous paper P to be conveyed. In each drawing, the conveyance direction of the continuous paper P (hereinafter, sometimes referred to as a "paper conveyance direction") is indicated by an arrow A as appropriate.

The configuration of the conveyance mechanism 20 is not limited to the above configuration. For example, the conveyance mechanism 20 may be a mechanism that conveys the continuous paper P from a housing unit in which the continuous paper P is housed in a folded state to a housing unit in which the continuous paper P is housed so as to be folded.

The conveyance mechanism 20 may be a mechanism using a pair of conveyance rollers, a conveyance belt, or the like as a conveyance member that conveys the continuous paper P.

Further, in the exemplary embodiment, the continuous paper P is used as the recording medium, but the exemplary invention is not limited thereto. For example, sheets of paper (that is, cut papers) may be used as the recording medium.

(Ejection Mechanism 30)

The ejection mechanism 30 shown in FIG. 1 is a mechanism that ejects ink droplets as an example of droplets. Specifically, the ejection mechanism 30 ejects ink droplets on the continuous paper P conveyed by the conveyance mechanism 20 to form an image. More specifically, as shown in FIG. 1, the ejection mechanism 30 includes ejection heads 32Y, 32M, 32C, and 32K (hereinafter, referred to as 32Y to 32K).

Each of the ejection heads 32Y to 32K is a head that ejects ink droplets. Specifically, the ejection heads 32Y to 32K eject ink droplets of colors of yellow (Y), magenta (M), cyan (C), and black (K) respectively on the continuous paper P to form an image on the continuous paper P. More specifically, each of the ejection heads 32Y to 32K is configured as follows.

As shown in FIG. 1, the ejection heads 32Y to 32K are disposed in this order toward upstream direction of the paper conveyance. Each of the ejection heads 32Y to 32K has a length of the continuous paper P in the width direction. The width direction of the continuous paper P is a direction intersecting with the paper conveyance direction (specifically, an orthogonal direction). In each drawing, the width direction of the continuous paper P is indicated by an arrow B as appropriate.

Each of the ejection heads 32Y to 32K has a nozzle surface 30S on which a nozzle (not shown) is formed. The nozzle surface 30S of each of the ejection heads 32Y to 32K faces downward and faces the continuous paper P conveyed by the conveyance mechanism 20. Each of the ejection heads 32Y to 32K ejects ink droplets from the nozzle (not shown) on the continuous paper P by a publicly known method such as a thermal method or a piezoelectric method.

For example, aqueous ink is used as the ink used in each of the ejection heads 32Y to 32K. The aqueous ink contains, for example, a solvent containing water as a main component, a colorant (specifically, a pigment, a dye, or the like), and other additives.

In the exemplary embodiment, the ejection head 32K is an example of a first ejection unit. The ejection head 32K ejects ink droplets on the continuous paper P to form a normal image 70 (see FIG. 2) and a detection mark 80. In other words, the detection mark 80 is formed of the ejection head disposed on the most upstream position in the paper conveyance direction.

The normal image 70 is an image formed on an image region R of each page P1 of the continuous paper P. The normal image 70 is also an image formed based on an image formation instruction input from the outside of a user terminal or the like. Further speaking, the normal image 70 is also an image formed based on image data acquired by the control device 50 together with the image formation instruction.

On the other hand, the detection mark 80 is an example of the image for detection. For example, the detection mark 80 is an image formed outside the image region R of each page P1 of the continuous paper P. The detection mark 80 is an image detected by the detection units 41, 42, and 43. Further speaking, the detection mark 80 is also an image formed based on image data acquired by the control device 50 together with the image formation instruction. In other words, the detection mark 80 may also be referred to as an image formed in a predetermined pattern based on image data memorized in advance. The detection mark 80 may be formed in the image region R of each page P1.

Each of the ejection heads 32C, 32M, and 32Y shown in FIG. 1 is an example of a second ejection unit. The ejection heads 32C, 32M, and 32Y ejection ink droplets on the continuous paper P at an ejection timing to be controlled by the control device 50.

Any one or two of the ejection heads 32C, 32M, and 32Y may be considered as an example of the second ejection unit. Therefore, in the exemplary embodiment, when the ejection head 32K is an example of the first ejection unit, at least one of the ejection heads 32C, 32M, and 32Y may be used as an example of the second ejection unit.

Further, when the ejection head 32K is an example of the first ejection unit and the ejection head 32M is an example of the second ejection unit, the ejection head 32C may be considered as an example of a third ejection unit. When the ejection head 32K is an example of the first ejection unit and the ejection head 32Y is an example of the second ejection unit, the ejection head 32C or the ejection head 32M may be considered as an example of the third ejection unit.

(Detection Units 41, 42, and 43)

The detection units 41, 42, and 43 shown in FIG. 1 are detection units that detect the detection marks 80. The detection units 41, 42, and 43 detect at least a front end of the detection mark 80. The front end is a downstream end in the paper conveyance direction. An example of the detection units 41, 42, and 43 includes a reflection type optical sensor.

In the exemplary embodiment, the detection units 41, 42, and 43 are disposed between the ejection heads 32Y to 32K. Specifically, the detection unit 41 is disposed between the ejection head 32K and the ejection head 32C in the paper conveyance direction. That is, the detection unit 41 is disposed downstream of the ejection head 32K and upstream of the ejection head 32C in the paper conveyance direction. The detection unit 41 may be disposed at a position having equal distances from the ejection head 32K and the ejection head 32C or at a position close to one of the ejection head 32K and the ejection head 32C.

The detection unit 42 is disposed between the ejection head 32C and the ejection head 32M in the paper conveyance direction. That is, the detection unit 42 is disposed downstream of the ejection head 32C and upstream of the ejection head 32M in the paper conveyance direction. The detection unit 42 may be disposed at a position having equal distances from the ejection head 32C and the ejection head 32M or at a position close to one of the ejection head 32C and the ejection head 32M.

The detection unit 43 is disposed between the ejection head 32M and the ejection head 32Y in the paper conveyance direction. That is, the detection unit 43 is disposed downstream of the ejection head 32M and upstream of the ejection head 32Y in the paper conveyance direction. The detection unit 43 may be disposed at a position having equal distances from the ejection head 32M and the ejection head 32Y or at a position close to one of the ejection head 32M and the ejection head 32Y.

The detection units 41, 42, and 43 are an example of detection units. In the exemplary embodiment, the detection unit 41 may be considered as an example of a first detection unit. In this case, at least one of the detection units 42 and 43 may be considered as an example of a second detection unit. In the exemplary embodiment, the detection unit 42 may be considered as an example of the first detection unit. In this case, the detection unit 43 may be considered as an example of the second detection unit.

(Control Device 50)

The control device 50 is a device that controls an operation of each part of the ink jet recording apparatus 10. Specifically, the control device 50 controls, for example, the ejection timing of each of the ejection heads 32Y to 32K.

In the exemplary embodiment, the control device 50 causes each of the ejection heads 32C, 32M, and 32Y to ejection after a predetermined prescribed time (hereinafter, referred to as "delay time") after each of the detection units 41, 42, and 43 detects the detection mark 80.

Further, the control device 50 predicts elongation amounts of the continuous paper P in the paper conveyance direction based on differences between a set time period and a detection time period from a reference time point to each time points when the detection units 41, 42, and 43 detect the detection mark 80, and performs retardation control for delaying the ejection timing from each of the ejection heads 32C, 32M, and 32Y based on the predicted elongation amounts.

Figure 2:
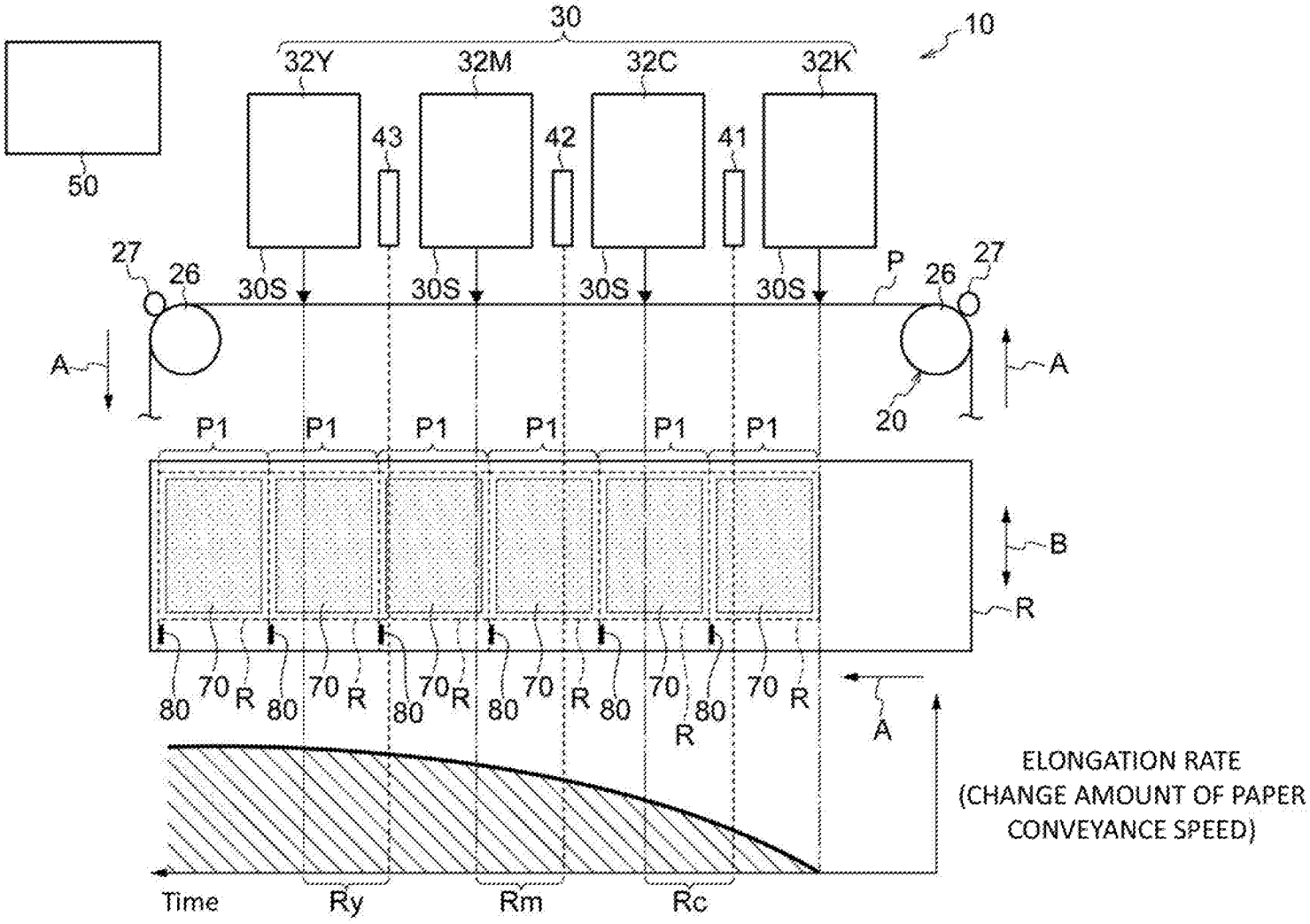
FIG. 2 is a schematic diagram showing an elongation rate (change amount of paper conveyance speed) of continuous paper in the ink jet recording apparatus according to the exemplary embodiment.

Here, the elongation of the continuous paper P in the paper conveyance direction occurs since the continuous paper P swells as the ink ejected on the continuous paper P penetrates into the continuous paper P. The swelling phenomenon proceeds over time. Therefore, as shown in FIG. 2, an elongation rate (that is, elongation amount) of the continuous paper P increases as the continuous paper is conveyed in the downstream direction from the ejection head 32K. Since the elongation rate is considered to be proportional to a change in the paper conveyance speed, a change amount of the paper conveyance speed increases as the continuous paper is conveyed in the downstream direction from the ejection head 32K.

The higher an image density of the normal image 70 is, the easier the continuous paper P swells, and as shown in FIG. 2, swelling of the continuous paper P is significant when the normal image 70 is a solid image (an image having an image density close to 100%). The image density refers to a ratio of an area occupied by the ejected ink per unit area (for example, area of the image region R) of the recording medium.

The change amount of the paper conveyance speed is determined by the following formula.

$$\text{Change amount of paper conveyance speed} = \text{elongation rate of continuous paper } P \text{ in paper conveyance direction} \times \text{paper conveyance speed}$$

An amount of displacement due to elongation of the continuous paper P (that is, a distance between a shifted position and an original position on the continuous paper P without elongation) is determined by integrating the change amount of the paper conveyance speed and corresponds to an area marked with diagonal lines in FIG. 2. Specifically, the amount of displacement occurring from when the detection unit 41 detects the detection mark 80 until when the ejection head 32C ejects ink droplets corresponds to an area Rc (hereinafter, sometimes referred to as a displacement amount Rc). The amount of displacement occurring from when the detection unit 42 detects the detection mark 80 until when the ejection head 32M ejects ink droplets corresponds to an area Rm (hereinafter, sometimes referred to as a displacement amount Rm). The amount of displacement occurring from when the detection unit 43 detects the detection mark 80 until when the ejection head 32Y ejects ink droplets corresponds to an area Ry (hereinafter, sometimes referred to as a displacement amount Ry).

The control device 50 determines retardation time corresponding to the displacement amount, and corrects displacement using time obtained by adding the retardation time to the delay time for ejecting from each of the ejection heads 32C, 32M, and 32Y.

Hereinafter, a specific configuration of the control device 50 will be described.

Figure 3:
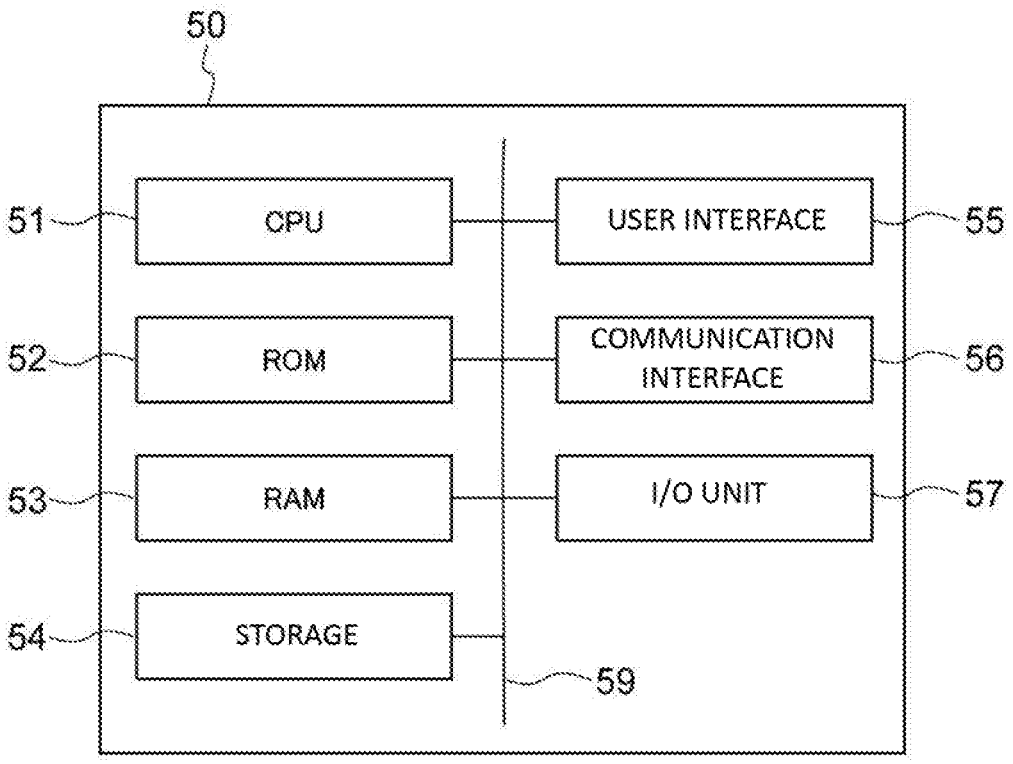
FIG. 3 is a block diagram showing a hardware configuration of a control device according to the exemplary embodiment.

FIG. 3 shows a block diagram showing a hardware configuration of the control device 50. The control device 50 is an example of a "control unit" and is an example of a "ejection control device".

As shown in FIG. 3, the control device 50 has a function as a computer, and includes a central processing unit (CPU): processor 51, a read only memory (ROM) 52, a random access memory (RAM) 53, a storage 54, a user interface 55, a communication interface 56, and an I/O unit 57. The units of the control device 50 are communicably connected to each other via a bus 59.

The CPU 51 is a central operation processing unit, and executes various programs and controls each unit. That is, the CPU 51 reads the program from the ROM 52 or the storage 54, and executes a program using the RAM 53 as a work area. The CPU 51 controls each unit of the ink jet recording apparatus 10 and performs kinds of operation processing in accordance with a program recorded in the ROM 52 or the storage 54.

The ROM 52 stores various programs and various data. The RAM 53 temporarily memorizes programs or data as the work area. The storage 54 includes a hard disk drive (HDD) or a solid state drive (SSD), and stores various programs including an operating system and various data.

The user interface 55 is an interface when a user as a user of the ink jet recording apparatus 10 uses the ink jet recording apparatus 10. The user interface 55 includes, for example, an input unit such as a button or a touch panel, and a display unit such as a liquid crystal display.

The communication interface 56 is an interface for communicating with a user terminal such as a personal computer. Wired or wireless communication is used as a communication method of the communication interface 56. As a communication standard of the communication interface 56, for example, Ethernet (registered trademark), FDDI, Wi-Fi (registered trademark), or the like is used. The I/O unit 57 connects the CPU 51 with each unit of the ink jet recording apparatus 10.

Figure 4:
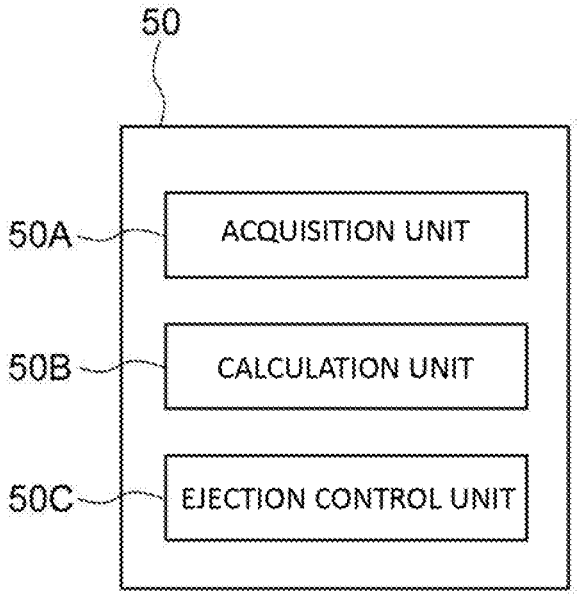
FIG. 4 is a block diagram showing an example of a functional configuration of the control device according to the exemplary embodiment.

When the above program is executed, the control device 50 realizes various functions by using the above hardware resources. A functional configuration realized by the control device 50 will be described. FIG. 4 is a block diagram showing an example of a functional configuration of the control device 50.

As shown in FIG. 4, the control device 50 includes an acquisition unit 50A, a calculation unit 50B, and an ejection control unit 50C as the functional configuration. The functional configuration is realized by reading and executing a control program memorized in the ROM 52 or the storage 54 by the CPU 51.

The acquisition unit 50A acquires detection information (that is, a detection result) that the detection units 41, 42, and 43 detect the detection marks 80.

The calculation unit 50B detects detection time period KTc from a time point (an example of a reference time point) when the ejection head 32K forms the detection mark 80 to a time point when the detection unit 41 detects the detection mark 80 based on the detection information acquired by the acquisition unit 50A.

The calculation unit 50B detects detection time period KTm from a time point (an example of a reference time point) when the detection unit 41 detects the detection mark 80 to a time point when the detection unit 42 detects the detection mark 80 based on the detection information acquired by the acquisition unit 50A.

Further, the calculation unit 50B detects detection time period KTy from a time point (an example of a reference time point) when the detection unit 42 detects the detection mark 80 to a time point when the detection unit 43 detects the detection mark 80 based on the detection information acquired by the acquisition unit 50A.

For example, the calculation unit 50B generates a clock signal, and detects detection times KTc, KTm, and KTy by the count number of clock signals from when the ejection head 32K forms the detection mark 80 until when each of the detection units 41, 42, and 43 detects the detection mark 80.

Further, the calculation unit 50B predicts the elongation amount of the continuous paper P in the paper conveyance direction from differences between the detection time periods KTc, KTm, and KTy and set time periods STc, STm, and STy of the respective ejection heads 32C, 32M, and 32Y, and calculates the retardation time Tc, Tm, and Ty of the elongation amount. The set time periods STc, STm, and STy are predetermined reference times (that is, nominal times), and correspond to detection times when the continuous paper P does not swell.

Specifically, the retardation times Tc, Tm, and Ty are calculated as follows.

Figure 5:
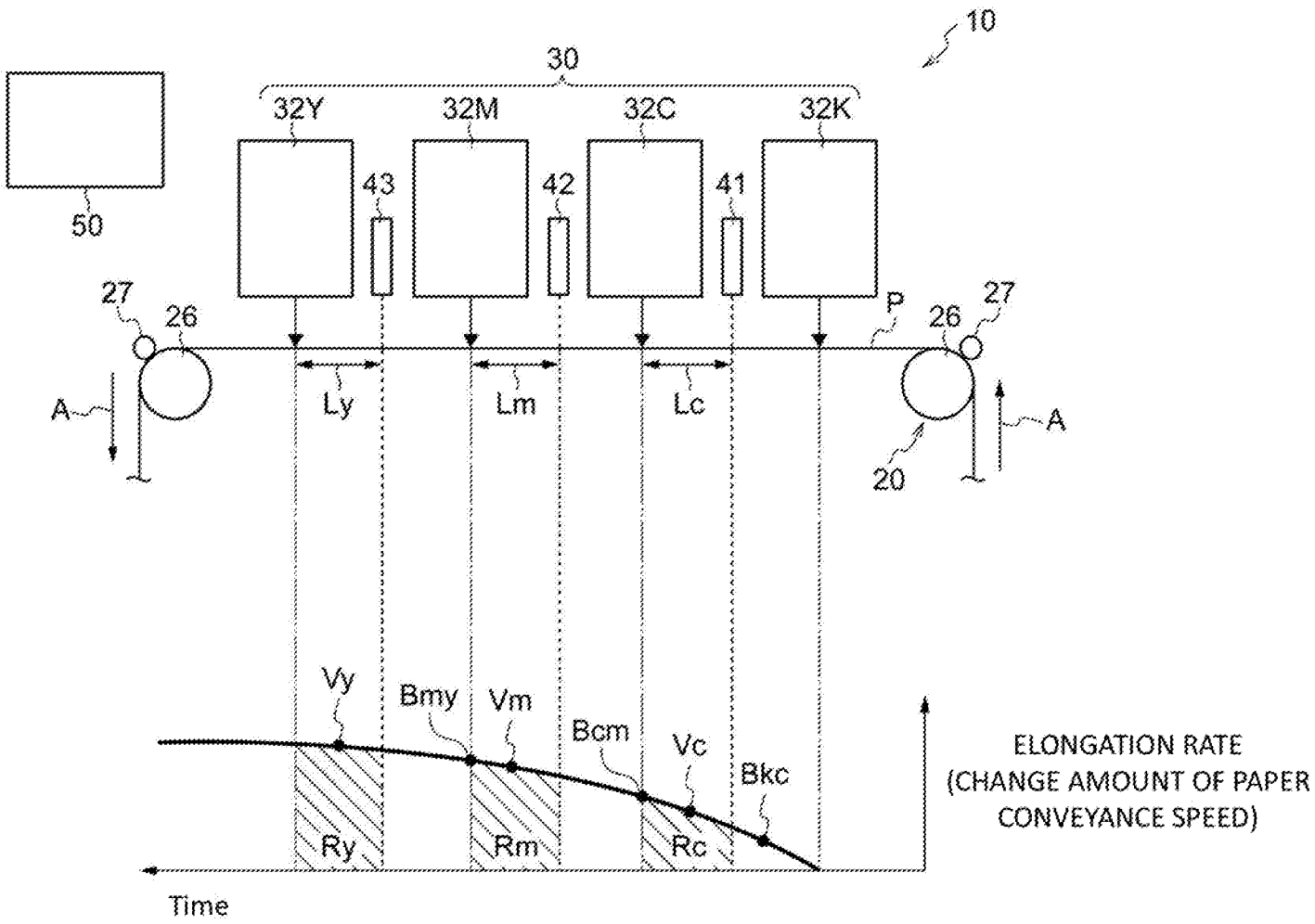
FIG. 5 is a schematic diagram showing the determined speed change amount and a displacement amount of the ink jet recording apparatus according to the exemplary embodiment.

First, a speed change amount Bkc (see FIG. 5) of a midpoint between the ejection head 32K and the detection unit 41 is determined by the following formula. The following formula approximately determines the speed change amount Bkc.

Speed change amount *Bkc*=difference time period÷set time period *STc*×paper conveyance speed Difference time period=detection time period *KTc*−set time period *STc*

Similarly, a speed change amount Bcm (see FIG. 5) of a midpoint between the detection unit 41 and the detection unit 42 is determined by the following formula.

Speed change amount *Bcm*=difference time period÷set time period *STm*×paper conveyance speed Difference time period=detection time period *KTm*−set time period *STm*

Similarly, a speed change amount Bmy (see FIG. 5) of a midpoint between the detection unit 42 and the detection unit 43 is determined by the following formula.

Speed change amount *Bmy*=difference time period÷set time period *STy*×paper conveyance speed Difference time period=detection time period *KTy*−set time period *STy*

Next, a speed change amount Vc of a midpoint between the detection unit 41 and the ejection head 32C is determined by the following formula. The following formula is obtained by predicting the speed change amount Vc from the speed change amount Bkc.

Speed change amount $Vc$=speed change amount $Bkc$×coefficient $Sc$

A speed change amount Vm of a midpoint between the detection unit 42 and the ejection head 32M is determined by the following formula.

Speed change amount $Vm$=speed change amount $Bcm$×coefficient $Sm$

Further, a speed change amount Vy of a midpoint between the detection unit 43 and the ejection head 32Y is determined by the following formula.

Speed change amount $Vy$=speed change amount $Bmy$×coefficient $Sy$

Next, a displacement amount Rc is determined by the following formula.

Displacement amount $Rc$=speed change amount $Vc$×distance $Lc$÷paper conveyance speed The distance Lc (see FIG. 5) is a distance from the detection unit 41 to the ejection head 32C.

A displacement amount Rm is determined by the following formula.

Displacement amount $Rm$=speed change amount $Vm$×distance $Lm$÷paper conveyance speed The distance Lm (see FIG. 5) is a distance from the detection unit 42 to the ejection head 32M.

Further, a displacement amount Ry is determined by the following formula.

Displacement amount $Ry$=speed change amount $Vy$×distance $Ly$÷paper conveyance speed The distance Ly (see FIG. 5) is a distance from the detection unit 43 to the ejection head 32Y.

Next, the retardation time Tc of the ejection head 32C is determined by the following formula.

Retardation time $Tc$=displacement amount $Rc$÷paper conveyance speed

The retardation time Tm of the ejection head 32M is determined by the following formula.

Retardation time $Tm$=displacement amount $Rm$÷paper conveyance speed

The retardation time Ty of the ejection head 32Y is determined by the following formula.

Retardation time $Ty$=displacement amount $Ry$÷paper conveyance speed

The ejection control unit 50C delays an ejection timing of each of the ejection heads 32C, 32M, and 32Y by the retardation time Tc, Tm, Ty calculated by the calculation unit 50B. Specifically, the ejection control unit 50C causes the ejection head 32C to eject droplets after a time obtained by adding the retardation time Tc to the predetermined delay time has passed from a time point when the detection unit 41 detects the detection mark 80.

The ejection control unit 50C causes the ejection head 32M to eject droplets after a time obtained by adding the retardation time Tm to the predetermined delay time has passed from a time point when the detection unit 42 detects the detection mark 80.

Further, the ejection control unit 50C causes the ejection head 32Y to eject droplets after a time obtained by adding the retardation time Ty to the predetermined delay time has passed from a time point when the detection unit 43 detects the detection mark 80.

Effects According to Exemplary Embodiment

Figure 6:
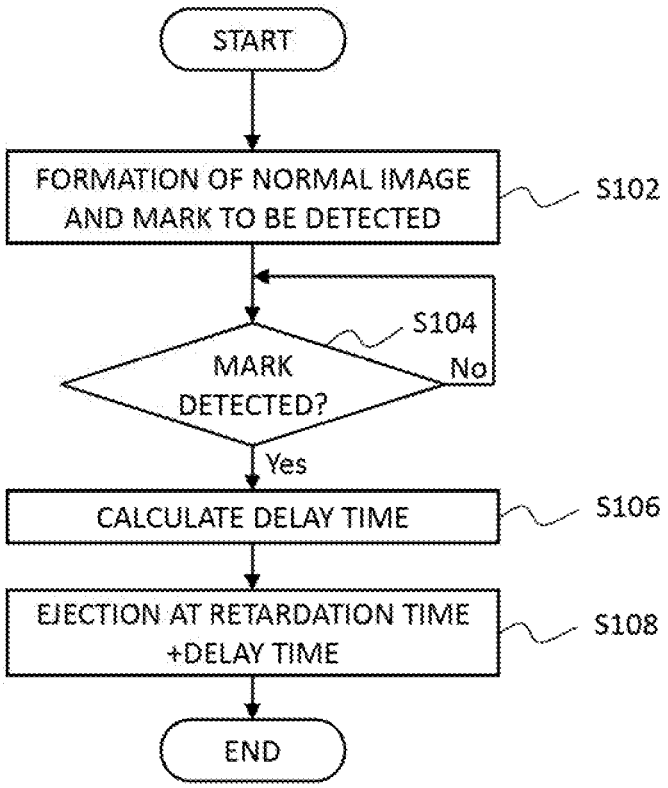
FIG. 6 is a flowchart illustrating a flow of control processing executed by the control device according to the exemplary embodiment.

Next, effects of the exemplary embodiment will be described. FIG. 6 is a flowchart illustrating a flow of control processing executed by the control device 50.

The CPU 51 performs control processing by reading and executing a control program from the ROM 52 or the storage 54. The CPU 51 performs the control processing, for example, when the CPU 51 acquires an instruction of forming a normal image 70 on the continuous paper P. The exemplary embodiment, for example, performs the control processing regardless of the image density of the normal image 70. The exemplary embodiment performs the control processing regardless of, for example, a paper type of the continuous paper P.

As shown in FIG. 6, when the control processing is started, the CPU 51 first drives the ejection head 32K to form the normal image 70 and the detection mark 80 on the continuous paper P (step S102).

Next, the CPU 51 determines whether the detection unit 41 has detected the detection mark 80 (step S104). When the CPU 51 determines that the detection unit 41 has detected the detection mark 80 in step S104 (step S104: YES), the process proceeds to step S106.

On the other hand, when the CPU 51 determines that the detection unit 41 has not detected the detection mark 80 in step S104 (step S104: NO), the CPU 51 repeats step S104 until the detection unit 41 detects the detection mark 80.

In step S106, the CPU 51 calculates the retardation time Tc as described above. Next, the CPU 51 causes the ejection head 32C to eject droplets (step S108) after a time obtained by adding the retardation time Tc to the predetermined delay time has passed from a time point when the detection unit 41 detects the detection mark 80.

In the ejection heads 32M and 32Y, similarly, the CPU 51 determines whether the detection units 42 and 43 have detected the detection marks 80 (step S104). If the CPU 51 determines that the detection units 42 and 43 have detected the detection marks 80 (step S104: YES), the CPU 51 calculates the retardation time Tm and Ty as described above.

Next, the CPU 51 causes the ejection heads 32M and 32Y to eject droplets (step S108) after a time obtained by adding the retardation time Tm and Ty to the predetermined delay time has passed from a time point when the detection units 42 and 43 detect the detection mark 80 respectively.

The exemplary embodiment performs retardation control on the page P1 where the detection mark 80 is formed at an ejection timing when the ejection heads 32C, 32M, and 32Y perform ejection.

As described above, the exemplary embodiment predicts the elongation amount of the continuous paper P in the paper conveyance direction, and performs the retardation control for delaying the ejection timing by the elongation amount on each of the ejection heads 32C, 32M, and 32Y.

Therefore, displacement between the ejection position of the ejection head 32K to the continuous paper P and the ejection positions of the ejection heads 32C, 32M, and 32Y to the continuous paper P is prevented as compared with a configuration in which the ejection timing of the ejection heads 32C, 32M, and 32Y is constant (Comparative Example A) regardless of the elongation amount of the continuous paper P in the conveyance direction.

(Evaluation)

Figure 7:
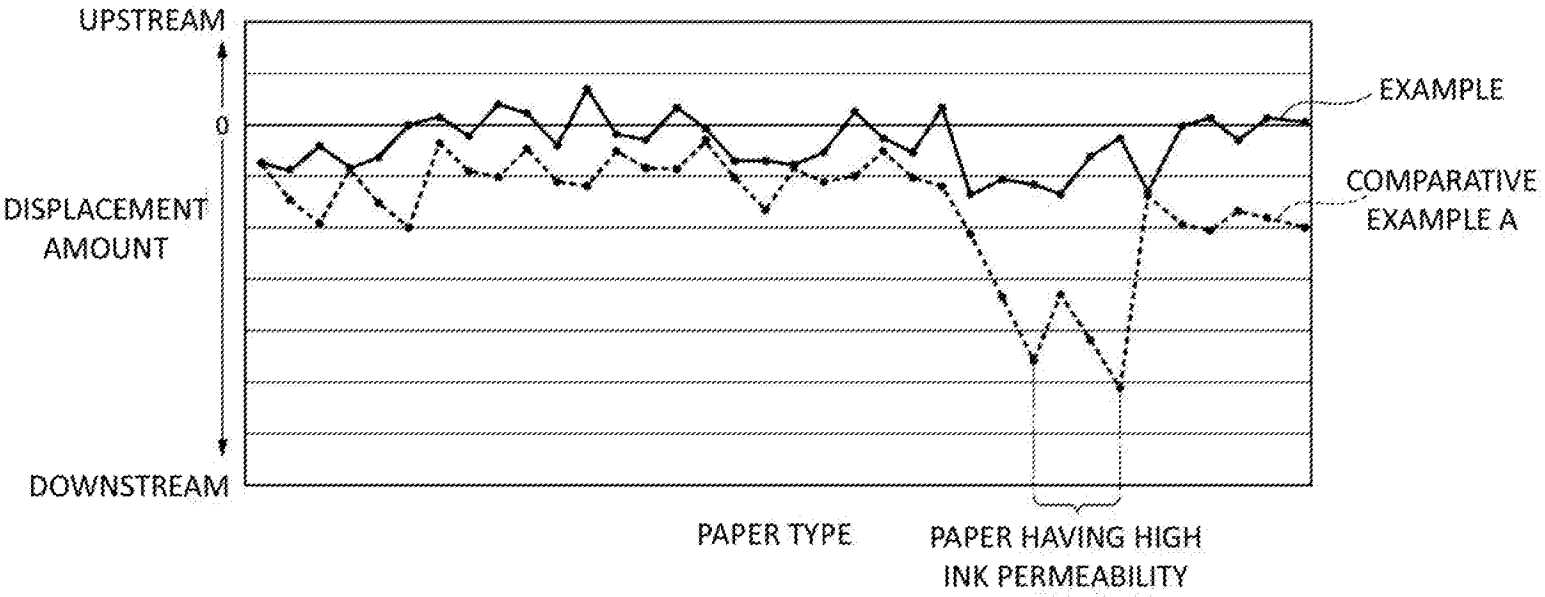
FIG. 7 is a graph showing evaluation results.

As shown in FIG. 7, the evaluation measures amounts of displacement between the ejection position of the ejection head 32K and the ejection positions of the ejection heads 32C, 32M, and 32Y on the continuous paper P in Example performing the control processing of the exemplary embodiment and in Comparative Example A not performing the control processing of the exemplary embodiment. The evaluation measures the displacement amount with changing the paper type of the continuous paper P. As a result, the exemplary embodiment has been found to prevent the displacement. In particular, the effect of preventing the displacement has been found to be large in a paper having high ink permeability (for example, uncoated high quality paper).

(First Modification)

The above exemplary embodiment determine a speed change amount Vc of a midpoint between the detection unit 41 and the ejection head 32C using the following formula.

Speed change amount $Vc$=speed change amount $Bkc$×coefficient $Sc$

Speed change amount $Bkc$=difference time period÷set time period $STc$×paper conveyance speed Difference time period=detection time period $KTc$−set time period $STc$ In other words, an elongation amount of the continuous paper P in the paper conveyance direction is predicted from a difference time period between the detection time period KTc and the setting time STc, but the present invention is not limited thereto.

For example, the speed change amount Vc may be determined by an interpolation method of the speed change amount Bkc calculated from detection information of the detection unit 41 and the speed change amount Bcm calculated from detection information of the detection unit 42.

In other words, an elongation amount of the continuous paper P in the paper conveyance direction may be predicted from a difference time period between the detection time period KTc and the set time period STc and a difference time period between the detection time period KTm and the set time period STm.

In this case, retardation control is performed on a next page P1 of the page P1 where the detection mark 80 is formed at a ejection timing when the ejection head 32C performs ejection.

In the configuration of the present modification, since the elongation amount of the continuous paper P in the paper conveyance direction is predicted by using a plurality of difference time periods, prediction accuracy is higher than that in a case where the elongation amount of the continuous paper P in the conveyance direction is predicted using a single difference time period, and the displacement between the ejection position of the ejection head 32K to the continuous paper P and the ejection position of the ejection head 32C to the continuous paper P is prevented.

Since the detection unit 42 used in the present modification is disposed downstream of the ejection head 32C in the conveyance direction, a distance between the ejection head 32K and the ejection head 32C is shorter than that in a configuration where the detection unit 42 is disposed upstream of the ejection head 32C in the conveyance direction.

Further, in the present modification, as described above, retardation control is performed on a next page P1 of the page P1 where the detection mark 80 is formed at an ejection timing when the ejection head 32C performs ejection.

Here, in a case where retardation control is performed on the predetermined page P1 where the detection mark 80 is formed at an ejection timing when the ejection head 32C performs ejection (Comparative Example B), the detection unit 42 detects the detection mark 80 of the page P1, and then the ejection head 32C needs to perform ejection to the page P1. Therefore, in the page P1 of the continuous paper P, since the ink droplets are ejected from the ejection head 32C at a position away from the detection mark 80 by a distance from the ejection head 32C to the detection unit 42, a margin of the distance from the ejection head 32C to the detection unit 42 is required for the page P1.

Correspondingly, in the exemplary embodiment, since the retardation control is performed on a next page P1 of the page P1 where the detection mark 80 is formed at an ejection timing when the ejection head 32C performs ejection, the margin formed on the continuous paper P is smaller than that in Comparative Example B.

In the present modification, the detection unit 41 is an example of a first detection unit. The detection unit 42 is an example of a second detection unit. The ejection head 32C may be considered as an example of the second ejection unit.

Further, when the ejection head 32M is considered as an example of the second ejection unit, the ejection head 32C may be considered as an example of a third ejection unit. In such a case of grasp, the ejection head 32C as an example of the third ejection unit is disposed between the detection unit 41 as an example of the first detection unit and the detection unit 42 as an example of the second detection unit in the paper conveyance direction. According to the configuration, for example, a difference between the distance between the ejection head 32K and the ejection head 32C and a distance between the ejection head 32M and the ejection head 32C is smaller than that in a configuration where the ejection head 32C is disposed upstream of the detection unit 41 and the detection unit 42 in the conveyance direction.

(Second Modification)

In the exemplary embodiment, a speed change amount Vm of a midpoint between the detection unit 42 and the ejection head 32M has been determined by the following formula.

Speed change amount $Vm$=speed change amount $Bcm$×coefficient $Sm$

Speed change amount $Bcm$=difference time period÷set time period $STm$×paper conveyance speed Difference time period=detection time period $KTm$−set time period $STm$ In other words, an elongation amount of the continuous paper P in the paper conveyance direction is predicted from a difference time period between the detection time period KTm and the set time period STm, but the present invention is not limited thereto.

For example, the speed change amount Vm may be determined by an interpolation method of the speed change amount Bcm calculated from detection information of the detection unit 42 and the speed change amount Bmy calculated from detection information of the detection unit 43.

In other words, an elongation amount of the continuous paper P in the paper conveyance direction may be predicted from a difference time period between the detection time period KTm and the set time period STm and a difference time period between the detection time period KTy and the set time period STy.

In the present modification, retardation control is performed on a next page P1 of the page P1 where the detection mark 80 is formed at an ejection timing when the ejection head 32C performs ejection. The present modification has the same effect as that of the first modification.

In the present modification, the detection unit 42 is an example of a first detection unit. The detection unit 43 is an example of a second detection unit. The ejection head 32M may be considered as an example of the second ejection unit. Further, when the ejection head 32Y is considered as an example of the second ejection unit, the ejection head 32C may be considered as an example of a third ejection unit.

(Third Modification)

Further, for example, the speed change amount Vm may be determined by an extrapolation method of the speed change amount Bkc calculated from detection information of the detection unit 41 and the speed change amount Bcm calculated from detection information of the detection unit 42.

In other words, an elongation amount of the continuous paper P in the paper conveyance direction may be predicted from a difference time period between the detection time period KTc and the set time period STc and a difference time period between the detection time period KTm and the set time period STm.

In the present modification, retardation control is performed on the page P1 where the detection mark 80 is formed at an ejection timing when the ejection head 32M performs ejection.

In the configuration of the present modification, since the elongation amount of the continuous paper P in the paper conveyance direction is predicted by using a plurality of difference time periods, prediction accuracy is higher than that in a case where the elongation amount of the continuous paper P in the conveyance direction is predicted using a single difference time period, and the displacement between the ejection position of the ejection head 32K to the continuous paper P and the ejection position of the ejection head 32M to the continuous paper P is prevented.

In the present modification, since the detection unit 42 is disposed upstream of the ejection head 32M in the conveyance direction, as in the second modification, it is not necessary to perform delay control on the next page P1 of the page P1 where the detection mark 80 is formed at an ejection timing when the ejection head 32C performs ejection, and delay control is performed on the page P1 where the detection mark 80 is formed at an ejection timing when the ejection head 32M performs ejection. Therefore, in the present modification, an execution timing of executing the delay control is earlier than that in the second modification.

In the present modification, the detection unit 41 is an example of a first detection unit. The detection unit 42 is an example of a second detection unit. The ejection head 32M may be considered as an example of the second ejection unit.

When the present modification is combined with the first modification described above, the elongation amount of the continuous paper P in the paper conveyance direction is predicted from the used difference time period in the first modification. According to the configuration, the elongation amount is predicted from the difference based on the detection time period detected by the detection unit different from the detection unit 41 and the detection unit 42, the number of components is reduced, and the control processing may be performed efficiently as compared with the case where delay control is performed on the ejection head 32C.

(Fourth Modification)

In the exemplary embodiment, a speed change amount Vy of a midpoint between the detection unit 43 and the ejection head 32M has been determined by the following formula.

Speed change amount $Vy$=speed change amount $Bmy$×coefficient $Sy$

Speed change amount $Bmy$=difference time period÷set time period $STy$×paper conveyance speed Difference time period=detection time period $KTy$−set time period $STy$ In other words, an elongation amount of the continuous paper P in the paper conveyance direction is predicted from a difference time period between the detection time period KTy and the set time period STy, but the present invention is not limited thereto.

For example, the speed change amount Vy may be determined by an extrapolation method of the speed change amount Bcm calculated from detection information of the detection unit 42 and the speed change amount Bmy calculated from detection information of the detection unit 43.

In other words, an elongation amount of the continuous paper P in the paper conveyance direction may be predicted from a difference time period between the detection time period KTm and the set time period STm and a difference time period between the detection time period KTy and the set time period STy.

In the present modification, retardation control is performed on the page P1 where the detection mark 80 is formed at an ejection timing when the ejection head 32M performs ejection. The present modification has the same effect as that of the third modification.

In the present modification, the detection unit 42 is an example of a first detection unit. The detection unit 43 is an example of a second detection unit. The ejection head 32Y may be considered as an example of the second ejection unit.

(Fifth Modification)

Figure 8:
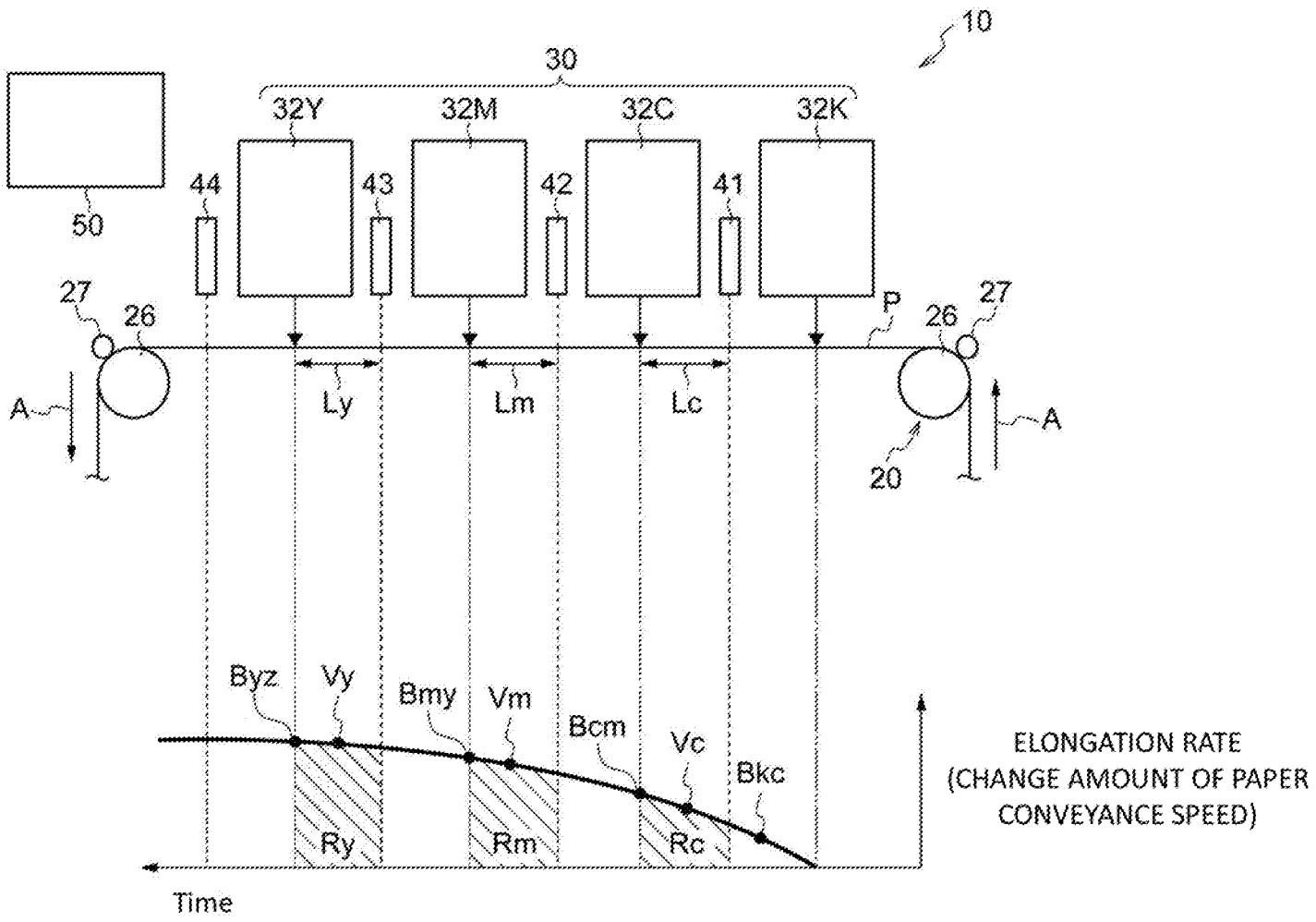
FIG. 8 is a schematic diagram showing a configuration of an ink jet recording apparatus according to a fifth modification.

Further, as shown in FIG. 8, the detection unit 44 may be provided on the downstream of the ejection head 32Y in the paper conveyance direction, and as described above, the speed change amount Byz at a midpoint between the ejection head 32Y and the detection unit 44 may be determined, and the speed change amount Vy may be determined by an interpolation method of the speed change amount Byz and the speed change amount Bmy calculated from the detection information of the detection unit 43.

In the present modification, retardation control is performed on a next page P1 of the page P1 where the detection mark 80 is formed at an ejection timing when the ejection head 32C performs ejection. The present modification has the same effect as that of the first modification.

(Other Modifications)

In the present embodiment, for example, the control processing is performed regardless of the image density of the normal image 70, but the present invention is not limited thereto. For example, when the image density is equal to or more than a predetermined threshold value in the normal image 70, the control processing may be executed.

In the exemplary embodiment, for example, the control processing is performed regardless of the paper type of the continuous paper P, but the present invention is not limited thereto. For example, when the paper has high ink permeability (for example, uncoated high quality paper), the control processing may be executed.

The present invention is not limited to the above exemplary embodiment, and various modifications, changes, and improvements may be made without departing from the scope of the invention. For example, the plurality of modifications shown above may be combined as appropriate.

In the embodiments above, the term "processor" refers to hardware in a broad sense. Examples of the processor includes general processors (e.g., CPU: Central Processing Unit), dedicated processors (e.g., GPU: Graphics Processing Unit, ASIC: Application Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An ejection apparatus comprising:

a first ejection unit configured to eject droplets on a recording medium conveyed in a conveyance direction to form an image for detection on the recording medium;

a first detection unit disposed downstream of the first ejection unit in the conveyance direction and configured to detect the image for detection;

a second detection unit disposed downstream of the first detection unit in the conveyance direction and configured to detect the image for detection;

a second ejection unit disposed downstream of the first detection unit in the conveyance direction and configured to eject droplets on the recording medium; and a control unit configured to:

predict a first elongation amount of the recording medium in the conveyance direction based on a first difference between a first set time period and a first detection time period from a reference time point to a first detection time point when the first detection unit detects the image for detection, and further based on a second difference between a second set time period and a second detection time period from the first detection time point to a second detection time point when the second detection unit detects the image for detection; and perform delay control on the second ejection unit for delaying an ejection timing of the second ejection unit based on the predicted elongation amount.

2. The ejection apparatus according to claim 1, wherein the second detection unit is disposed downstream of the second ejection unit in the conveyance direction.

3. The ejection apparatus according to claim 2, wherein the recording medium comprises a plurality of pages, the first ejection unit is configured to form the image for detection on a predetermined page of the recording medium, and the control unit is configured to perform the delay control for the ejection timing of the second ejection unit when the second ejection unit performs ejection on a next page upstream of the predetermined page in the conveyance direction.

4. The ejection apparatus according to claim 1, wherein the second detection unit is disposed on an upstream of the second ejection unit in the conveyance direction.

5. The ejection apparatus according to claim 4, further comprising:

a third ejection unit disposed downstream of the first detection unit and upstream of the second detection unit in the conveyance direction and configured to eject droplets on the recording medium.

6. The ejection apparatus according to claim 5, wherein the control unit is further configured to perform a delay control on the third ejection unit for delaying an ejection timing of the third ejection unit based on the predicted elongation amount.

7. An ejection apparatus comprising:

a first ejection unit configured to eject droplets on a recording medium conveyed in a conveyance direction to form an image for detection on the recording medium;

a first detection unit disposed downstream of the first ejection unit in the conveyance direction and configured to detect the image for detection;

a second ejection unit disposed downstream of the first detection unit in the conveyance direction and configured to eject droplets on the recording medium; and a control unit configured to:

predict a first elongation amount of the recording medium in the conveyance direction based on a first difference between a first set time period and a first detection time period from a reference time point to a first detection time point when the first detection unit detects the image for detection, wherein the reference time point is a time point when the first ejection unit ejects droplets to form the image for detection on the recording medium; and perform delay control on the second election unit for delaying an ejection timing of the second ejection unit based on the predicted elongation amount.

8. An ejection control device comprising:

a processor configured to:

predict an elongation amount of a recording medium conveyed in a conveyance direction based on a first difference between a first set time period and a first detection time period from a time point when a first ejection unit ejects droplets to form an image for detection on the recording medium to a first detection time point when a first detection unit detects the image for detection, and further based on a second difference between a second set time period and a second detection time period from the first detection time point to a second detection time point when a second detection unit detects the image for detection, the second ejection unit being disposed downstream of the detection unit in the conveyance direction; and perform delay control for delaying an ejection timing from a second ejection unit disposed downstream of the detection unit in the conveyance direction based on the predicted elongation amount.

9. The ejection control device according to claim 8, wherein the recording medium comprises a plurality of pages, the first ejection unit is configured to form the image for detection on a predetermined page of the recording medium, and the processor is configured to perform the delay control for the ejection timing of the second ejection unit when the second ejection unit performs ejection on a next page upstream of the predetermined page in the conveyance direction.

10. The ejection control device according to claim 9, wherein the control unit is further configured to perform a delay control on a third ejection unit for delaying an ejection timing of the third ejection unit based on the predicted elongation amount, the third ejection unit being disposed between the first detection unit and the second detection unit in the conveyance direction and configured to eject droplets on the recording medium.

* * * * *